US011856382B2

(12) United States Patent
Griffiths et al.

(10) Patent No.: US 11,856,382 B2
(45) Date of Patent: Dec. 26, 2023

(54) ACOUSTIC TRANSDUCER HAVING DROP RING CONNECTED AT RESONANT NODE

(71) Applicant: Dolby Laboratories Licensing Corporation, San Francisco, CA (US)

(72) Inventors: Kelvin Francis Griffiths, Porthcawl (GB); Timothy Erin Sandrik, Missouri, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 17/775,638

(22) PCT Filed: Nov. 18, 2020

(86) PCT No.: PCT/US2020/061131

§ 371 (c)(1),
(2) Date: May 10, 2022

(87) PCT Pub. No.: WO2021/102056

PCT Pub. Date: May 27, 2021

(65) Prior Publication Data

US 2022/0400347 A1 Dec. 15, 2022

Related U.S. Application Data

(60) Provisional application No. 63/048,240, filed on Jul. 6, 2020, provisional application No. 62/937,380, filed on Nov. 19, 2019.

(51) Int. Cl.

| | |
|---|---|
| ***H04R 9/04*** | (2006.01) |
| ***H04R 7/04*** | (2006.01) |
| ***H04R 31/00*** | (2006.01) |

(52) U.S. Cl.
CPC ..... *H04R 9/043* (2013.01); *H04R 7/04* (2013.01); *H04R 31/003* (2013.01)

(58) Field of Classification Search
CPC ..... H04R 9/043; H04R 7/04; H04R 31/003
See application file for complete search history.

(56) References Cited

U.S. PATENT DOCUMENTS

| | | | |
|---|---|---|---|
| 7,197,154 | B2 | 3/2007 | Sahyoun |
| 7,570,780 | B2 | 8/2009 | Baeten |
| 7,599,511 | B2 | 10/2009 | Corynen |

(Continued)

FOREIGN PATENT DOCUMENTS

| | | | | |
|---|---|---|---|---|
| EP | 912072 A1 * | 4/1999 | ..... | H04R 7/20 |
| EP | 0912072 B1 | 7/2005 | | |

OTHER PUBLICATIONS

Aaron Trimble "Tech Talk: Subwoofer Suspension Options" Mar. 2018 http://ddaudio.com/ddownlow/tech-talk-subwoofer-suspension-options.

(Continued)

*Primary Examiner* — Sunita Joshi

(57) ABSTRACT

An acoustic transducer that includes a housing, a diaphragm, a spider, a motor, and a drop ring. The motor includes a backplate, a frontplate, a magnet, and a voice coil. The drop ring connects the diaphragm to the spider at a circumference of the spider. The drop ring extends parallel with respect to a central axis of the housing. The circumference of the spider is spaced away from the motor and connects to the diaphragm at a resonant node of the diaphragm.

20 Claims, 17 Drawing Sheets

(56) References Cited

U.S. PATENT DOCUMENTS

| | | | |
|---|---|---|---|
| 8,204,269 | B2 | 6/2012 | Sahyoun |
| 8,422,724 | B2 | 4/2013 | Corynen |
| 8,428,294 | B2 | 4/2013 | Liu |
| 9,693,146 | B2 | 6/2017 | Little |
| 9,967,664 | B1 | 5/2018 | Quek |
| 10,034,094 | B2 | 7/2018 | Perkins |
| 2009/0026007 | A1 | 1/2009 | Corynen |
| 2009/0290748 | A1 | 11/2009 | Kam |
| 2012/0250931 | A1 | 10/2012 | Diedrich |
| 2015/0071481 | A1 | 3/2015 | Little |

OTHER PUBLICATIONS

Dayton Audio LW-450-4, created on Aug. 17, 2015. https://www.daytonaudio.com/product/1275/lw150-4-6-low-profile-woofer-4-ohms.

* cited by examiner

ACOUSTIC TRANSDUCER HAVING DROP RING CONNECTED AT RESONANT NODE

CROSS-REFERENCE TO RELATED APPLICATIONS

The present application claims priority to U.S. Provisional Patent Application No. 62/937,380, filed Nov. 19, 2019, and United States Provisional Patent Application No. 63/048,240, filed Jul. 6, 2020, which are incorporated herein by reference in their entirety.

FIELD

Embodiments described herein relate to an acoustic transducer.

BACKGROUND

FIG. 1 illustrates an example section through a subwoofer 100 and stack-up of components. The subwoofer 100 includes a basket or housing 105, a diaphragm 110, a motor 115, and a spider 120. The motor 115 includes a backplate 125, a voice coil 130, and a frontplate 135. The spider 120 is connected to the voice coil 130 at a former 140. The subwoofer 100 includes at least two clearance excursions. The first clearance excursion is defined as a distance, $D_1$, between the backplate 125 of the motor 115 and the base of the voice coil 130. The second clearance excursion is defined as a distance, $D_2$, between the spider 120 and a portion of the housing 105. A third distance, $D_D$, can be used to describe the distance between the diaphragm 110 and the front plate 135. The diaphragm 110 illustrated in FIG. 1 is a flat diaphragm. Alternatively, some subwoofers shape the diaphragm 110 (e.g., into a cone shape) to increase the structural rigidity of the diaphragm 110.

The subwoofer 100 includes one degree of freedom (i.e., linear motion in a direction normal to the backplate 125). The low frequency acoustic output of the subwoofer 100 is governed by air volume displacement or excursion (e.g., how far the diaphragm 110 travels from a resting position).

SUMMARY

Achieving high-quality bass reproduction in a product having small product dimensions is very difficult for electroacoustic designers. The difficulty increases as the product dimensions become smaller and where the desire for high-quality bass reproduction remains. Smaller product dimensions can be achieved using smaller speakers. However, the physics related to bass reproduction (i.e., producing low frequency soundwaves) are unfavorable to small speakers or speakers with small diaphragm sizes.

The low frequency output of subwoofers is governed by air volume displacement or excursion (e.g., how far a diaphragm of the speaker travels from a resting position). As a result, the diaphragm operates as a rigid piston that moves in a linear manner, driven by the motor. The resultant linear motion of the diaphragm should closely represent the electrical input waveform to the motor, and should do so even at higher amplitudes which may be required to achieve sound pressure levels that balance with other, complementary (e.g., higher frequency) speakers in a speaker system. However, bass reproduction requires larger diaphragm excursions. The use of large excursions in a subwoofer means that, in addition to including the motor components within the speaker, allowances should be made for the movement of the diaphragm and attached components in order to prevent mechanical contact between them (e.g., over-excursion, bottoming out, etc.).

In some embodiments, acoustic transducers described herein include a housing, a diaphragm, a spider, a motor, and a drop ring. The motor includes a backplate, a frontplate, a magnet, and a voice coil. The drop ring connects the diaphragm to the spider at a free circumference of the spider. The drop ring extends parallel with respect to a central axis of the housing.

The free circumference of the spider is spaced away from the motor and connects to the diaphragm at a resonant node of the diaphragm.

In some embodiments, methods of manufacturing an acoustic transducer described herein include determining a nodal point of a diaphragm, attaching the diaphragm to a housing or basket via a surround suspension, attaching the spider to a drop ring at a free circumference of the spider, and attaching the drop ring to the diaphragm at the nodal point.

As a result, embodiments described herein enable the depth or thickness of the subwoofer to be reduced by utilizing space surrounding the motor to lower the drop ring while ensuring the stability or rigidity of the subwoofer during operation. For example, by mounting the drop ring radially away or outward from the motor package and parallel to the central axis, the drop ring utilizes the same linear space as the motor and an excursion allowance for the motor. The drop ring does not then require a separate excursion allowance for its own movement. The excursion allowance for the motor and the excursion allowance for the drop ring are effectively combined into single excursion allowance without sacrificing the performance of the subwoofer.

Additionally, the drop ring mounted radially away from the motor package can be connected to the diaphragm at a position that helps maintain the diaphragm's rigidity up to a frequency where the subwoofer is attenuated out of the system and a higher frequency speaker is used. The position, determined by dynamic analysis of the loudspeaker assembly, is, for example, the resonant node position of the diaphragm.

As an additional thermal robustness consideration, because the drop ring is mounted radially away from the motor package, voice coil heating will not affect the spider adhesive joint. The combination of high mechanical stresses and heat transfer from the voice coil can result in motor detachment and is a common failure mode in drivers.

Additionally, because the spider is mounted radially away from the motor package, the spider has an increased overall (outer and inner) diameter. The increased diameter of the spider improves the axial linearity of the movement of the spider because the deformation of the spider results in lower mechanical stress. For this reason, the increased diameter of the spider also improves the performance and reliability (e.g., robustness) of the motor.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled.

It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

Other aspects of the embodiments will become apparent by consideration of the detailed description and accompanying drawings.

DETAILED DESCRIPTION

Figure 2:
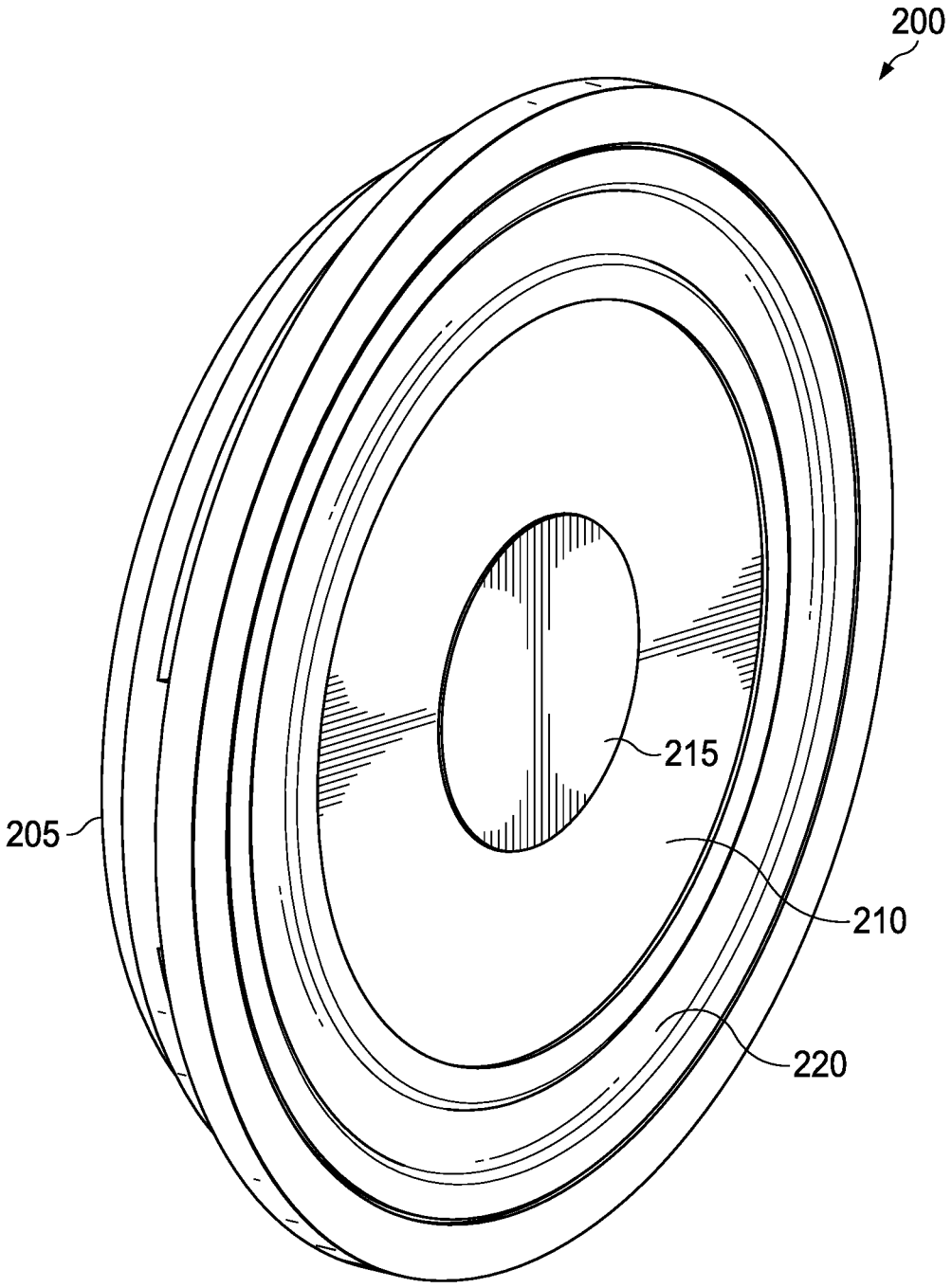
FIG. 2 is a perspective view of a subwoofer, according to embodiments described herein.
Figure 3:
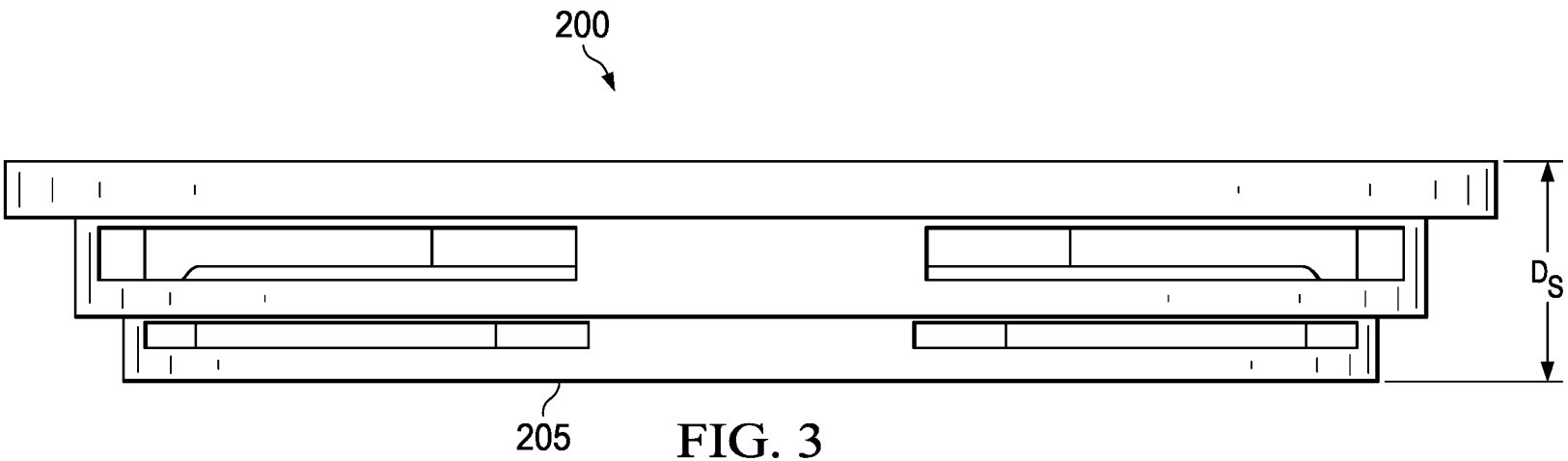
FIG. 3 is a side view of the subwoofer of FIG. 2.

FIGS. 2 and 3 illustrate an embodiment of an acoustic transducer 200 (e.g., a speaker, a subwoofer, etc.). The acoustic transducer 200 illustrated in FIGS. 2 and 3 is a subwoofer that includes a basket or housing 205 (e.g., a generally-cylindrical basket), a diaphragm 210, a dust cap 215, and a surround 220. The subwoofer 200 is configured to reduce or minimize a depth, $D_S$, of the subwoofer 200 (see FIG. 3). In order to reduce or minimize the depth, $D_S$, of the subwoofer 200, the internal structure of the subwoofer 200 is designed to maximize the use of the internal space of the subwoofer 200.

Figure 4:
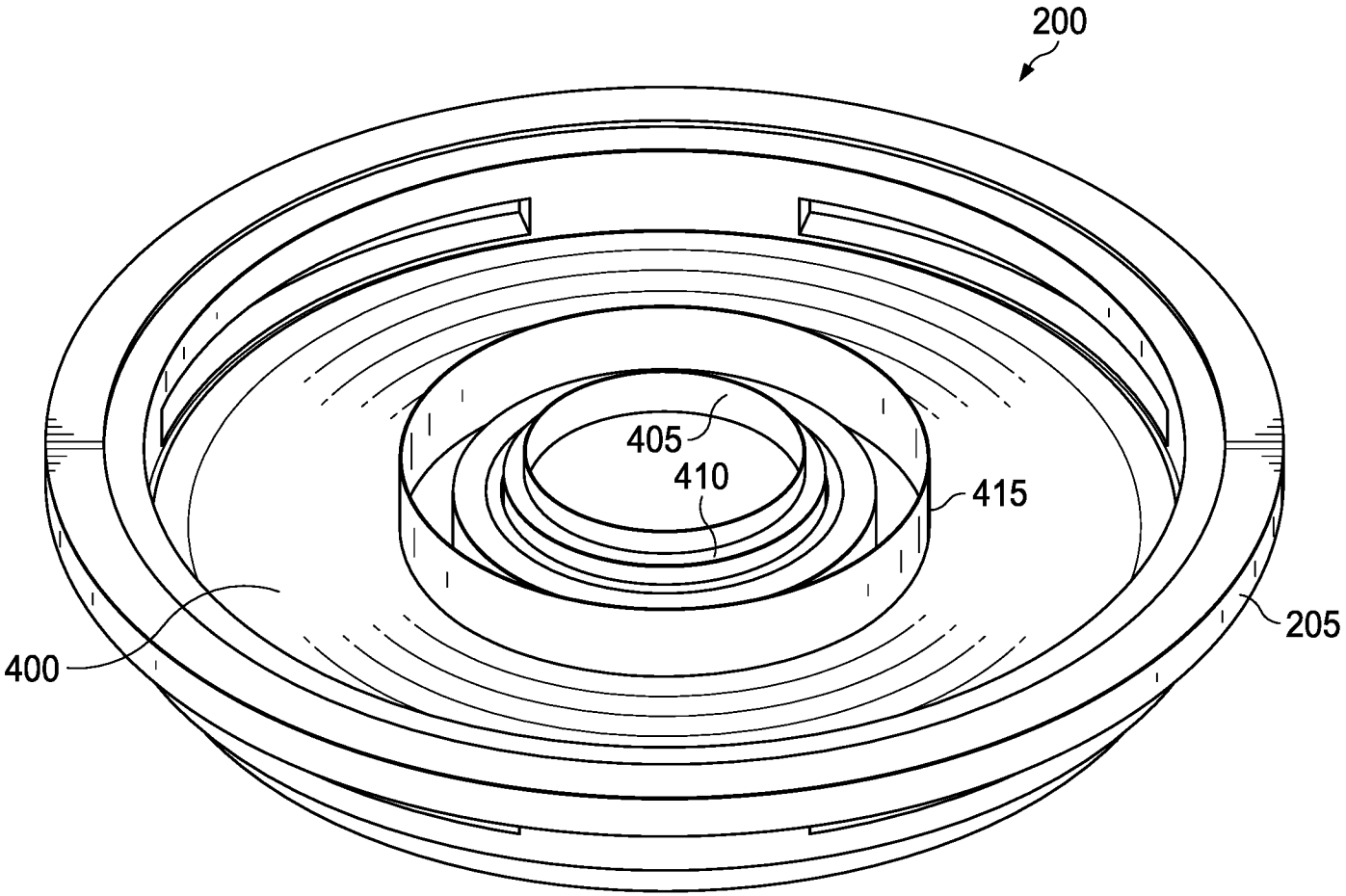
FIG. 4 is a perspective view of the subwoofer of FIG. 2 with a diaphragm removed, according to embodiments described herein.

FIG. 4 illustrates the subwoofer 200 with the diaphragm 210, the dust cap 215, and the surround 220 removed. As shown in FIG. 4, the subwoofer 200 includes a spider or damping spider 400, a former 405, a voice coil 410, and a secondary member or drop ring 415 (e.g., a connector, a rigid linkage, or a similar component for securing the damping spider 400 to the diaphragm). The former 405 and the drop ring 415 are approximately parallel to one another relative to a central axis of the basket 205. In some embodiments, the former 405 and/or the drop ring 415 are made of aluminum, cellular plastic, or the like. In some embodiments, the former 405 and/or the drop ring 415 is manufactured as part of the diaphragm 210.

Figure 1:
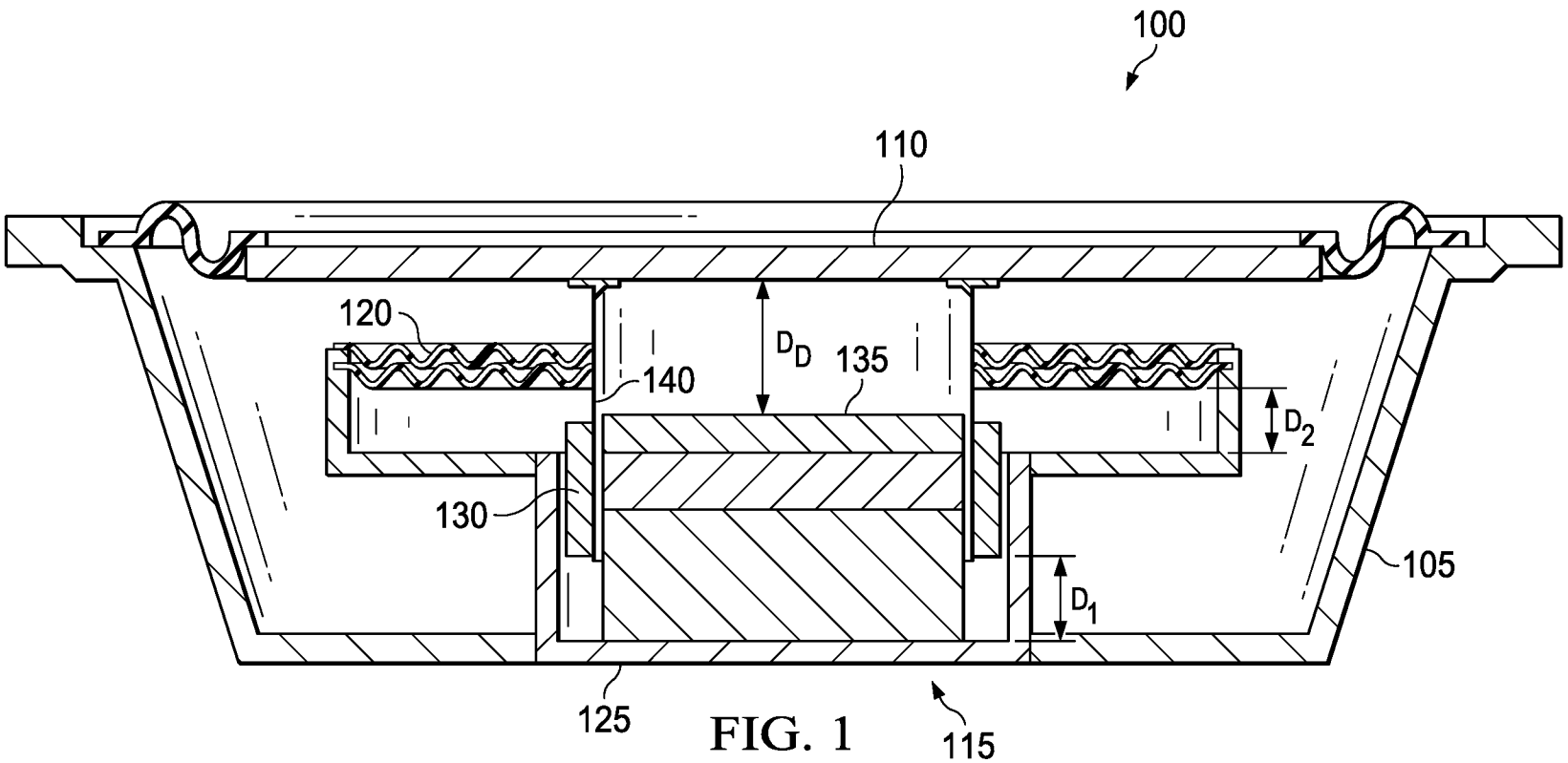
FIG. 1 illustrates a subwoofer.
Figure 5:
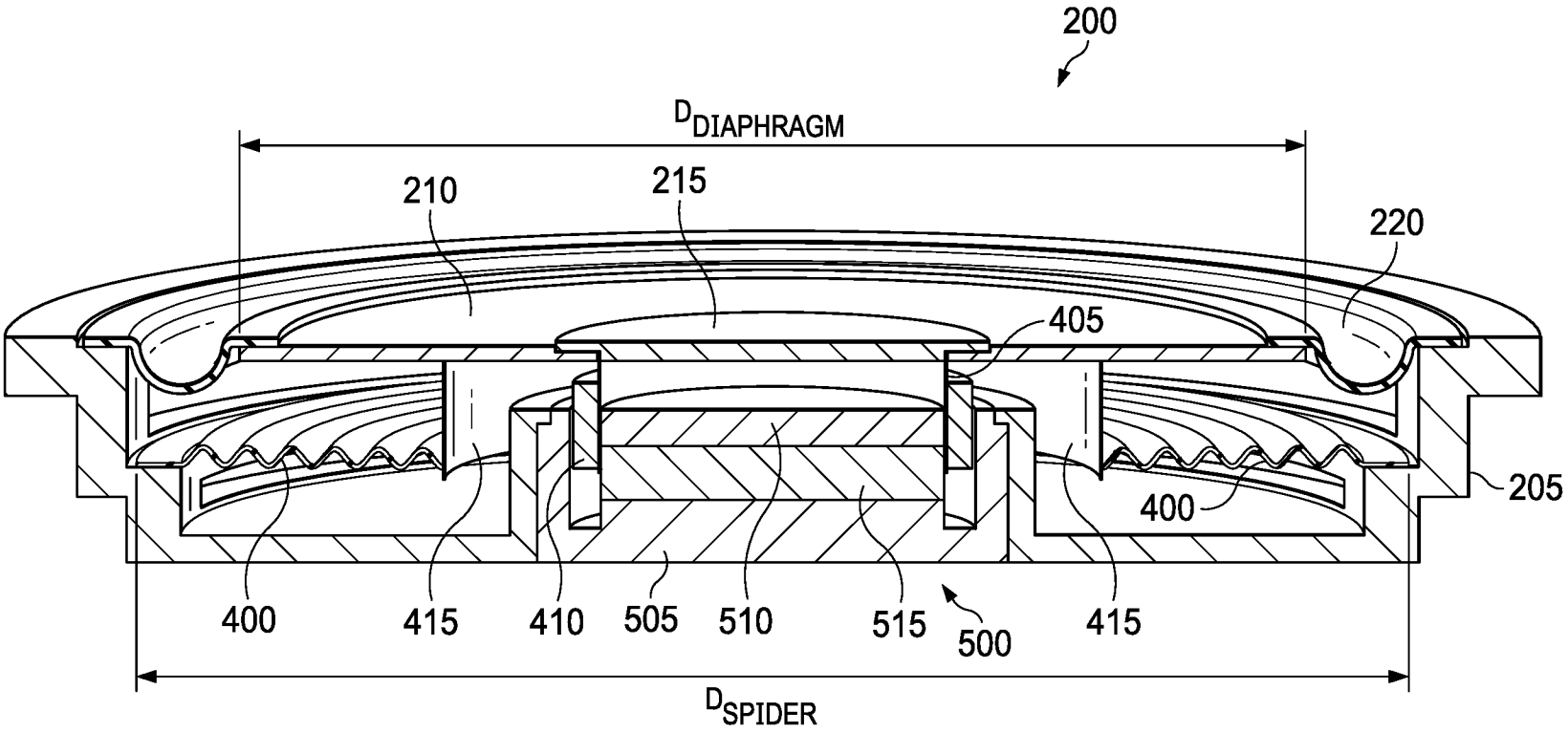
FIG. 5 is a cross-sectional, perspective side view of the subwoofer of FIG. 2, according to embodiments described herein.

The subwoofer 200 is shown in a perspective, cross-sectional view in FIG. 5. As shown in FIG. 5, the subwoofer 200 includes a motor 500. The motor 500 includes a backplate 505, a frontplate 510, a magnet 515, the former 405, and the voice coil 410. Because the spider 400 is mounted outside or radially away from the motor 500 (e.g., with respect to a central axis of the basket 205), the spider 400 has an increased inside diameter and outside diameter, $D_{SPIDER}$, relative to the comparative subwoofer 100 of FIG. 1. The larger diameter of the spider 400 improves the axial linearity of the movement of the spider 400 because the deformation of the spider 400 produces lower mechanical stresses. The increased diameter of the spider 400 also improves the performance and reliability (e.g., robustness) of the motor 500.

In some embodiments, based on, for example, the materials used to manufacture the subwoofer 200, the diameter of the spider, $D_{SPIDER}$, is greater than a diameter of the diaphragm 210, $D_{DIAPHRAGM}$. In other embodiments, based on, for example, the materials used to manufacture the subwoofer 200, the diameter of the spider, $D_{SPIDER}$, is approximately equal to the diameter of the diaphragm 210, $D_{DIAPHRAGM}$. In other embodiments, based on, for example, the materials used to manufacture the subwoofer 200, the diameter of the spider, $D_{SPIDER}$, is smaller than the diameter of the diaphragm 210, $D_{DIAPHRAGM}$. In some embodiments, the subwoofer 200 includes more than two drop rings.

Figure 6:
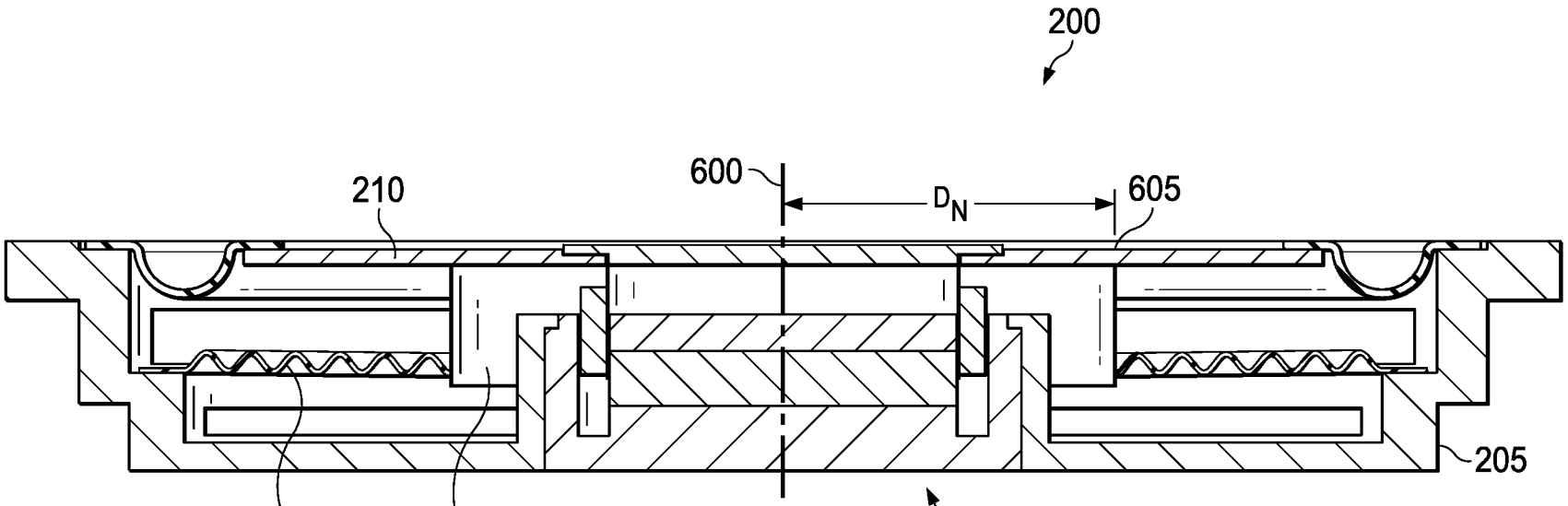
FIG. 6 is a cross-sectional side view of the subwoofer of FIG. 2, according to embodiments described herein.

With reference to FIG. 6, the subwoofer 200 includes a central axis 600 with respect to a back surface of the subwoofer 200. The drop ring 415 is spaced apart from the motor 500 (e.g., the spider 400 is not physically connected to the motor 500). In some embodiments, the drop ring 415 is spaced away from the motor 500 (e.g., the spider 400 can be physically connected to the motor 500). The drop ring 415 is connected at a first end or circumference of the spider 400 to the diaphragm 210 at a nodal point 605 that corresponds to a vibrational resonant node of the diaphragm 210.

The spider 400 is connected at a second end or circumference to the basket 205. In some embodiments, a distance, $D_N$, to the nodal point 605 (e.g., to the drop ring 415 and the spider 400) is measured from the central axis 600 of the subwoofer 200.

The nodal point 605 corresponds to the region of minimum movement about which the diaphragm 210 experiences bending. The location of the nodal point 605 on the diaphragm 210 can vary based on variables such as, for example, the size of the subwoofer 200, the size of the diaphragm 210, the thickness of the diaphragm 210, the material from which the diaphragm 210 is constructed, etc. Each of these variables can affect the flexural resonant frequency of the diaphragm 210 and, therefore, the location of the nodal point 605. The nodal point 605 can be located using, for example, a finite element model with inputs related to the materials of the subwoofer 200 and the geometry of the subwoofer 200. By positioning the connection between the drop ring 415 and the diaphragm 210 at the nodal point 605, the rigidity and stability of the diaphragm is increased while flexural resonance is reduced. Stabilizing the diaphragm 210 in such a manner enables improved performance of the subwoofer 200 near the upper range of frequencies produced by the subwoofer. For example, in some embodiments, the subwoofer 200 is configured to produce frequencies in the range approximately 30 Hz to approximately 200 Hz. With the performance at the upper range of the produced frequencies (i.e., approaching 200 Hz) being improved, the subwoofer is able to produce high quality sound up to the upper limit of the subwoofer 200, at which point the subwoofer 200 is attenuated out of the system and a higher frequency speaker is used.

Locating the nodal point 605 for the subwoofer 200 can be achieved using physical modeling techniques (e.g., the finite element method ["FEM"]). FEM can be used to locate the nodal point as well as tune the subwoofer 200's structure dynamically such that bending resonances that would normally exist in the diaphragm 210 can be manipulated (e.g., changed in frequency and/or reduced in magnitude). For example, the resonances can be manipulated by modifying the attachment position of the drop ring 415 to the diaphragm 210, modifying the mass of the diaphragm 210, modifying the mechanical damping of the spider 400, etc. Such manipulations of the resonances of the diaphragm 210 enable the use of a flat (e.g., non-conical) design for the diaphragm 210. A flat diaphragm 210 allows for reduced overall depth of the subwoofer 200 as compared to a non-flat diaphragm. As a result, the subwoofer 200 does not use a recessed or conical diaphragm to increase diaphragm rigidity, which could introduce a depth penalty.

Figure 7:
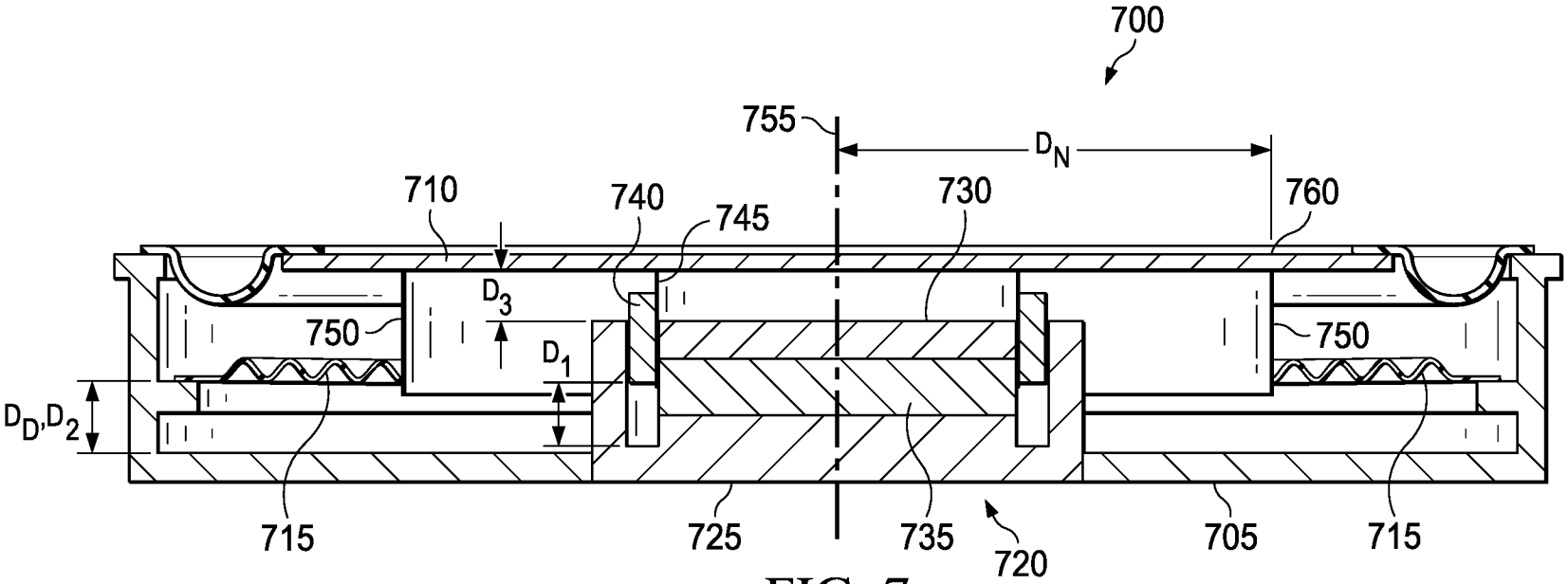
FIG. 7 illustrates a subwoofer, according to embodiments described herein.

FIG. 7 illustrates another embodiment of an acoustic transducer 700. The acoustic transducer 700 illustrated in FIG. 7 is a subwoofer 700. The subwoofer 700 includes a basket or housing 705, a diaphragm 710, a spider 715, and a motor 720. The motor 720 includes a backplate 725, a frontplate 730, a magnet 735, a voice coil 740, and a former 745. The subwoofer 700 also includes a drop ring 750 and a central axis 755 of the basket 705. As illustrated in FIG. 7, the former 745 and the drop ring 750 are each approximately parallel to the central axis 755 of the subwoofer 700.

Similar to the configuration described above with respect to FIG. 6, the drop ring 750 is connected to the diaphragm 710 at a nodal point 760. The distance, $D_N$, to the nodal point 760 is measured from the central axis 755 of the subwoofer 700. With the secondary drop ring configuration for the subwoofer 700 illustrated in FIG. 7 (or subwoofer 200 illustrated in FIGS. 2-6), clearance excursions can be defined with respect to the moving portions of the subwoofer 700. A first clearance excursion is defined as a first distance, $D_1$, between the backplate 725 of the motor 720 and the base of the voice coil 740. The second clearance excursion is defined as a second distance, $D_2$, between the spider 715 and a rear portion of the basket 705. Because of the drop ring 750, the second distance, $D_2$, that defines the second clearance excursion also defines the clearance excursion for the diaphragm 710. Additionally, a third distance, $D_3$, can be used to describe the distance between the diaphragm 710 and the frontplate 730. In some embodiments, the first distance, $D_1$, is greater than the second distance, $D_2$, and the third distance, $D_3$. In other embodiments, the first distance, $D_1$, is approximately equal to the second distance, $D_2$, and the third distance, $D_3$. In some embodiments, the third distance, $D_3$, is greater than the second distance, $D_2$. In other embodiments, the third distance, $D_3$, is approximately equal to the second distance, $D_2$. In other embodiments, the third distance, $D_3$, is less than the second distance, $D_2$.

Figure 8:
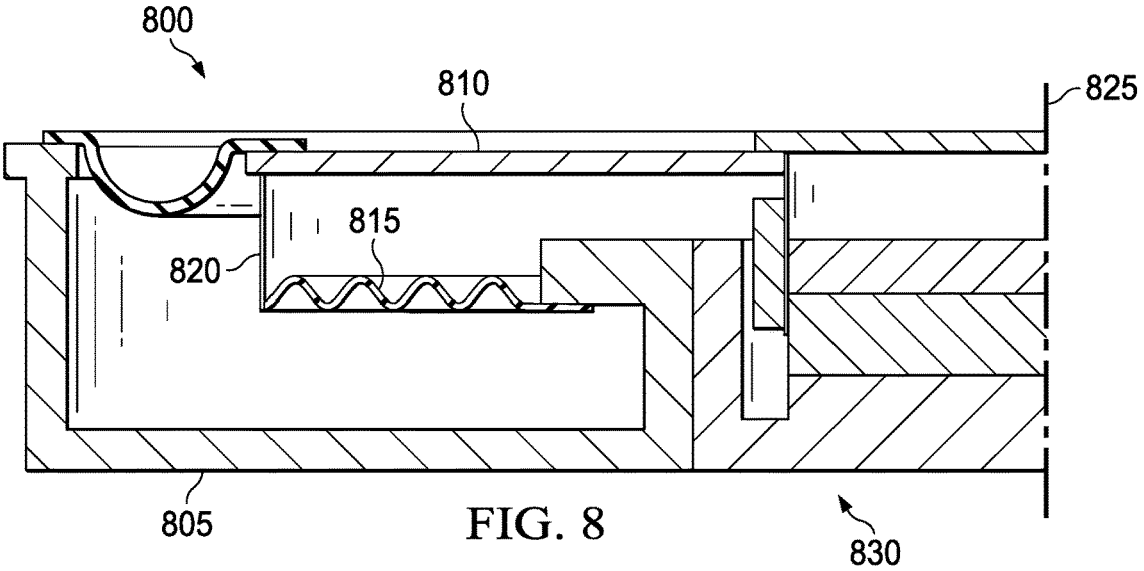
FIG. 8 illustrates a subwoofer, according to embodiments described herein.

FIG. 8 illustrates a partial view of another embodiment of an acoustic transducer 800. The acoustic transducer 800 illustrated in FIG. 8 is a subwoofer 800. The following description of further embodiments focuses on the differences with previously described embodiments.

Therefore, it should be assumed that features of the previously described embodiments are or at least can be implemented in these further embodiments, unless explicitly stated otherwise. The subwoofer 800 includes a basket or housing 805, a diaphragm 810, a spider 815, a secondary member or drop ring 820, a central axis 825 of the basket 805, and an inner portion 830 of the basket 805. The subwoofer 800 is similar to other subwoofers described herein in that the drop ring is approximately parallel to the central axis 825 of the subwoofer 800. However, the subwoofer 800 has the spider 815 connected to the drop ring 820 at a first end and to the inner portion 830 of the basket 805 at a second end. Connecting the spider 815 to the inner portion 830 of the basket 805 such that the spider 815 is positioned inside of the drop ring 820 produces a different stiffness-displacement characteristic than when a spider is positioned outside of the drop ring 820. In some embodiments, such a configuration provides useful counter balancing compared to when a spider is positioned outside of a drop ring 820.

Figure 9A:
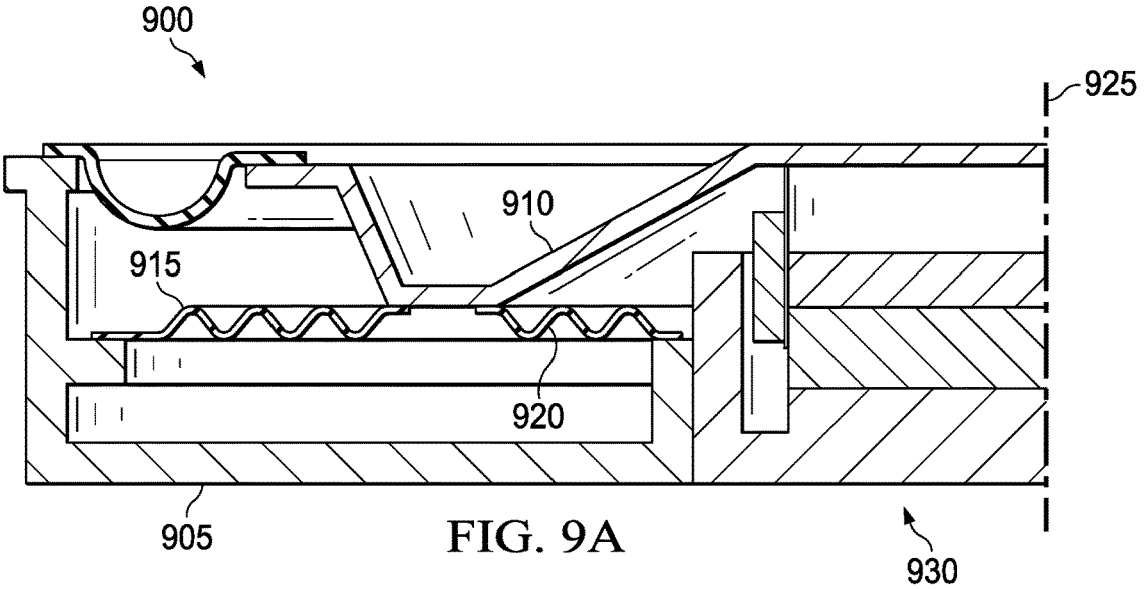
FIG. 9A illustrates a subwoofer, according to embodiments described herein.

FIG. 9A illustrates a partial view of another embodiment of an acoustic transducer 900. The acoustic transducer 900 illustrated in FIG. 9A is a subwoofer 900. The following description of further embodiments focuses on the differences with previously described embodiments.

Therefore, it should be assumed that features of the previously described embodiments are or at least can be implemented in these further embodiments, unless explicitly stated otherwise. The subwoofer 900 includes a basket or housing 905, a diaphragm 910, a first spider 915, a second spider 920 (e.g., to provide additional damping), a central axis 925 of the basket 905, and a motor 930. The subwoofer 900 illustrated in FIG. 9A does not include a drop ring.

Rather, the diaphragm 910 is contoured inward for connection to the first spider 915 and the second spider 920. In other embodiments, the subwoofer 900 includes a drop ring to which both the first spider 915 and the second spider 920 connect. Combining the first spider 915 and the second spider 920 provides design flexibility in achieving a target stiffness-excursion characteristic for the subwoofer 900 (e.g., to improve large signal performance of the motor 930).

Figure 9B:
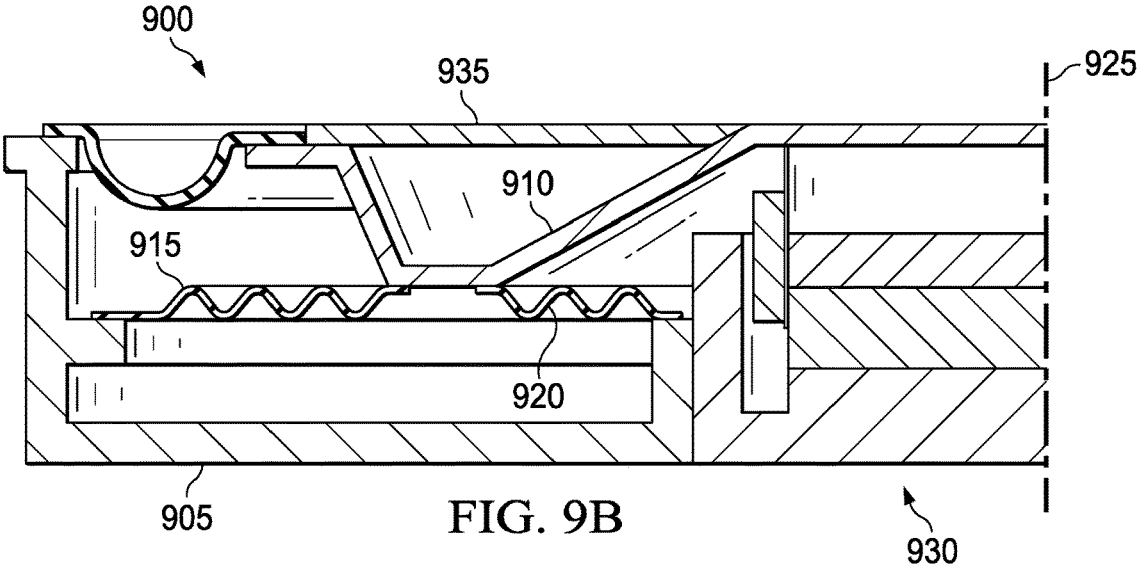
FIG. 9B illustrates a subwoofer, according to embodiments described herein.

FIG. 9B also illustrates a partial view of the acoustic transducer 900. However, the acoustic transducer 900 of FIG. 9B includes a reinforcing cover ring 935. The cover ring 935 functions as a bracing ring for the diaphragm 910 to increase the structural rigidity of the diaphragm 910. In some embodiments, the cover ring 935 is adhered (e.g., glued) to the diaphragm after the diaphragm is manufactured.

Embodiments described herein also include a method of manufacturing or configuring an acoustic transducer (e.g., a speaker, a subwoofer, etc.). The following description of further embodiments focuses on the differences with previously described embodiments. Therefore, it should be assumed that features of the previously described embodiments are or at least can be implemented in these further embodiments, unless explicitly stated otherwise. For example, with reference to FIG. 10 and an embodiment of an acoustic transducer 1000, manufacturing the acoustic transducer includes providing a basket or housing 1005. A diaphragm 1010 is attached to the basket 1005. A spider 1015 is attached to the basket 1005 at a first circumference of the spider 1015. The spider 1015 is attached to a member or drop ring 1020 at a second circumference of the spider. The second circumference of the spider 1015 is spaced apart from a motor. In some embodiments, the drop ring 1020 is parallel to a central axis 1025 of the basket 1005. The method of manufacturing the acoustic transducer 1000 includes determining a nodal point 1030 of the diaphragm 1010, as previously described. The drop ring 1020 is then attached to the diaphragm 1010 at the nodal point 1030. The double-sided arrow in FIG. 10 illustrates that, depending upon variations in properties or characteristics of the acoustic transducer 1000 from transducer to transducer, the nodal point 1030 can be located at different positions on the diaphragm 1010, and the distance, $D_N$, to the nodal point 1030 can vary from transducer to transducer.

Figure 10:
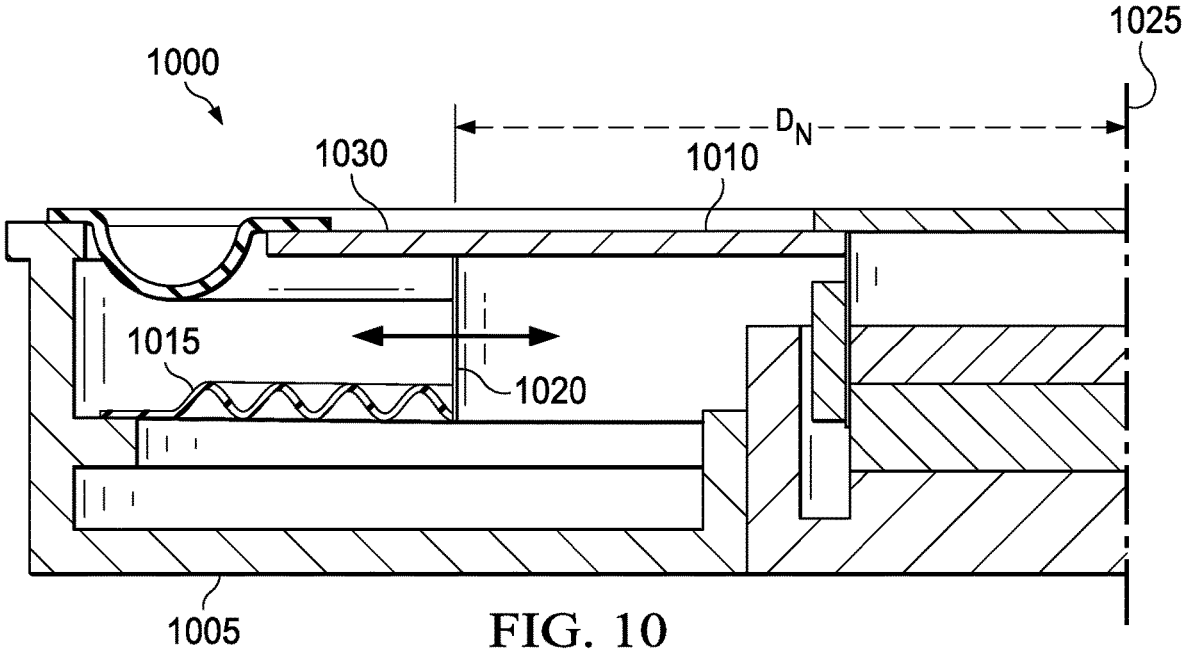
FIG. 10 illustrates a subwoofer, according to embodiments described herein.

Specifically, FIG. 10 illustrates how the nodal point 1030 can be positioned with respect to the central axis 1025. For example, the nodal point 1030 can be located closer to or further away from the central axis 1025 in the radial direction. A determination for where to locate the nodal point 1030 can take into account distributed model behavior of the subwoofer 1000 and its structures using numerical modeling tools (e.g., FEM). Using these numerical modeling techniques, resonant behavior (e.g., harmonic distortion) of the diaphragm 1010, stiffness of the diaphragm 1010, and excursion characteristics of the subwoofer 1000 can all be balanced to achieve a desired level of performance.

Figure 11A:
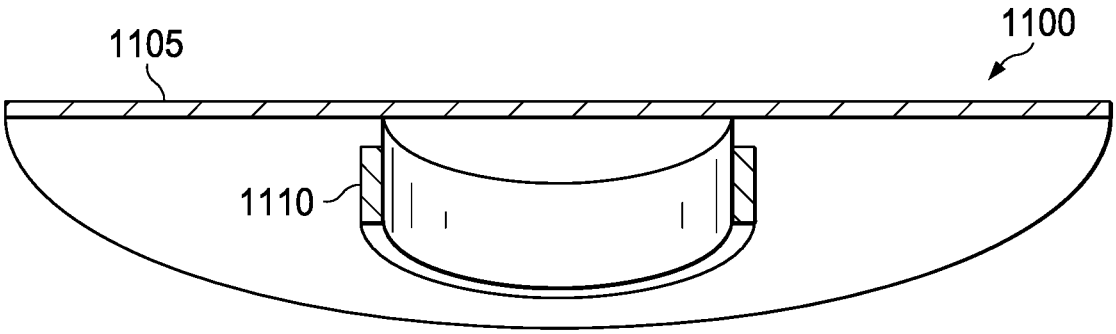
FIGS. 11A, 11B, and 11C illustrate drop ring configurations for a subwoofer.
Figure 11B:
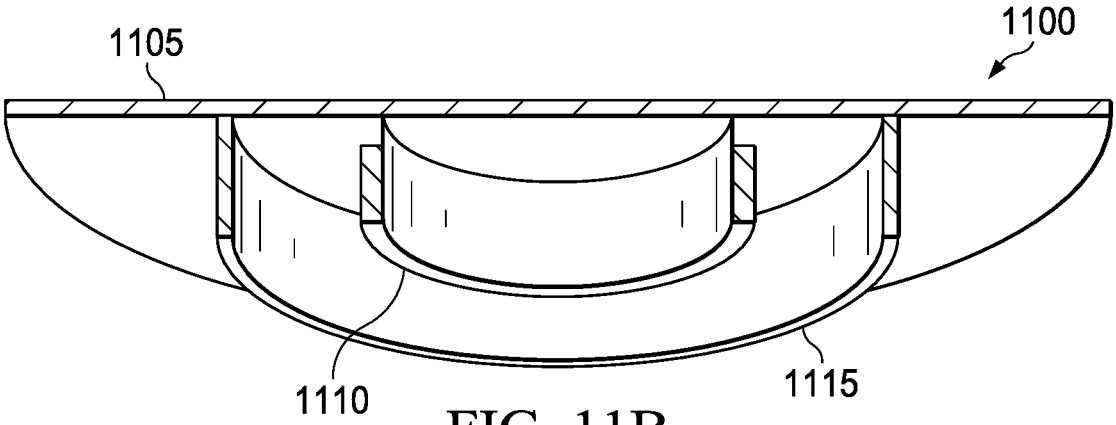
Figure 11C:
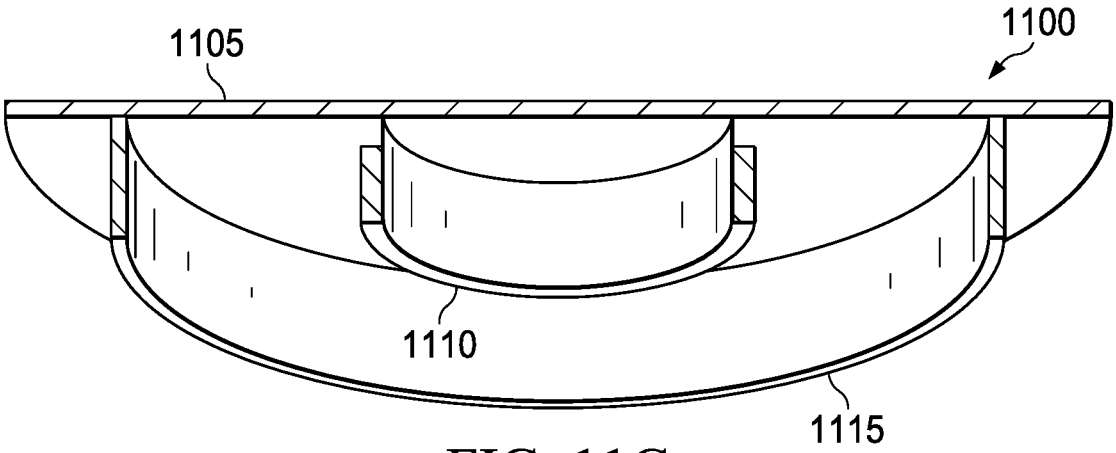

FIGS. 11A-11C illustrate a partial view of another embodiment of an acoustic transducer 1100 with several components removed for descriptive purposes. The acoustic transducer 1100 illustrated in FIGS. 11A-11C is, for example, a subwoofer 1100. The following description of further embodiments focuses on the differences with previously described embodiments. Therefore, it should be assumed that features of the previously described embodiments are or at least can be implemented in these further embodiments, unless explicitly stated otherwise. The acoustic transducer 1100 in FIG. 11A includes a diaphragm 1105 and a former 1110. The acoustic transducer 1100 is illustrated in FIG. 11A without a drop ring in order to show the performance improvement of the acoustic transducer 1100 when a drop ring is included in the acoustic transducer 1100. FIG. 11B illustrates a drop ring 1115 that is positioned at the nodal point of the diaphragm 1105. The drop ring 1115 is, for example, made of a light cellular plastic material and has a uniform width of approximately 2 mm (e.g., is rectangular in shape). FIG. 11C illustrates a drop ring 1115 that is positioned outside of the nodal point of the diaphragm 1105 (i.e., further away from the center of the diaphragm than the nodal point).

Figure 11D:
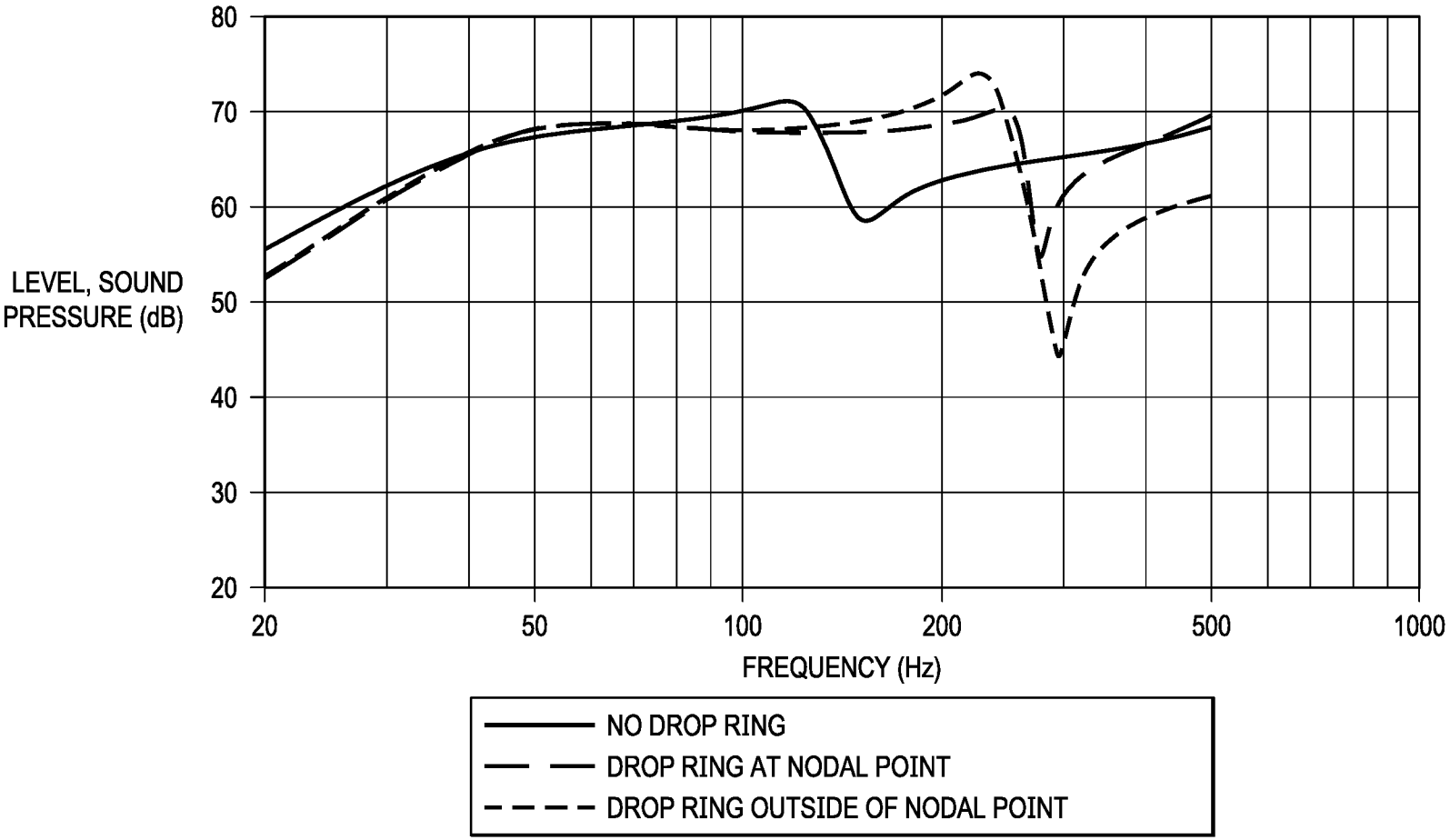
FIG. 11D is a graph of sound pressure versus frequency for the drop ring configurations illustrated in FIGS. 11A, 11B, and 11C.

FIG. 11D is a graph that illustrates the frequency response characteristics of the acoustic transducer 1100 of FIGS. 11A, 11B, and 11C. The embodiment of the acoustic transducer 1100 that does not include a drop ring demonstrates a significant reduction in sound pressure when the frequency of the acoustic transducer 1100 reaches approximately 125 Hz (i.e., the resonant frequency of the acoustic transducer 1100). The flexure associated with the diaphragm assembly resonance results in a loss of sound pressure and produces harmonic distortion in the output of the speaker that is undesirable. As such, the higher the frequency at which the diaphragm assembly resonance occurs, the better the acoustic transducer 1100 will perform. If the acoustic transducer 1100 is a subwoofer, which would not typically be operated at frequencies greater than approximately 200 Hz, having the sound pressure reduction occur at a frequency greater than 200 Hz would greatly improve the overall performance of the acoustic transducer 1100. As shown in FIG. 11D, both of the embodiments of the acoustic transducer 1100 that include the drop ring 1115 (both at the nodal point and outside the nodal point of the acoustic transducer 1100) demonstrate a sound pressure reduction at a frequency of greater than approximately 200 Hz (e.g., approximately 250 Hz). As a result, the drop ring 1115 significantly improves the frequency response characteristics of the acoustic transducer 1100.

Figure 12A:
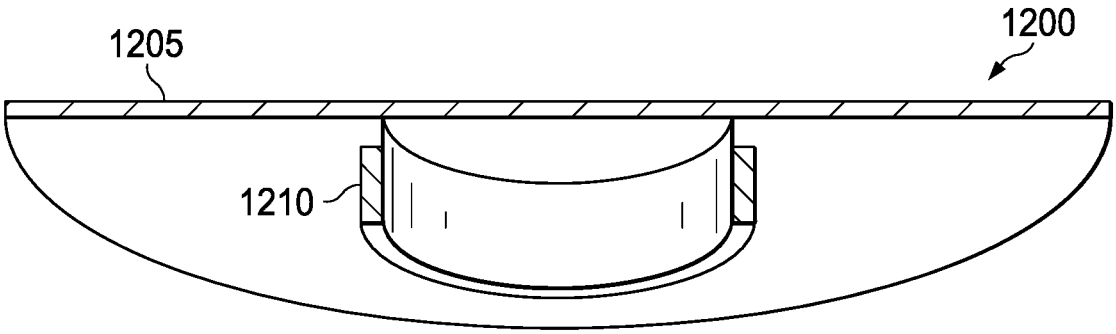
FIGS. 12A, 12B, and 12C illustrate drop ring configurations for a subwoofer.
Figure 12B:
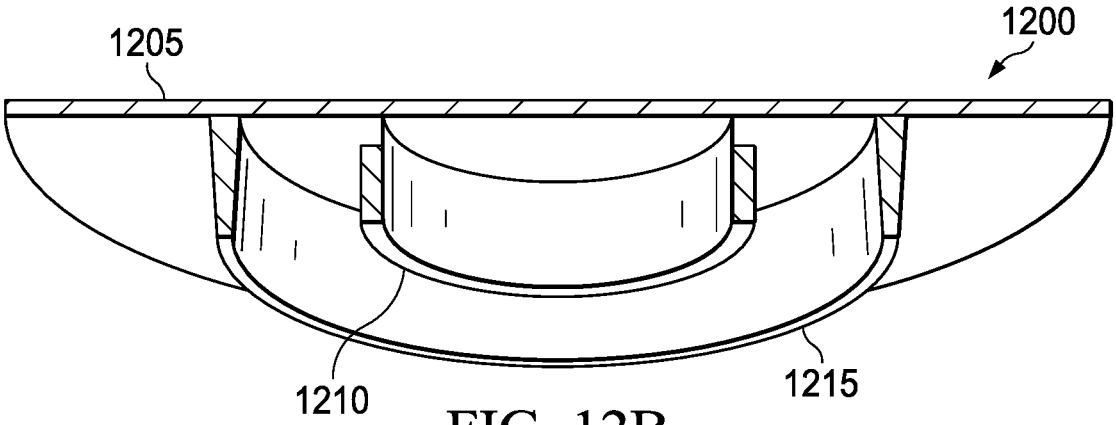
Figure 12C:
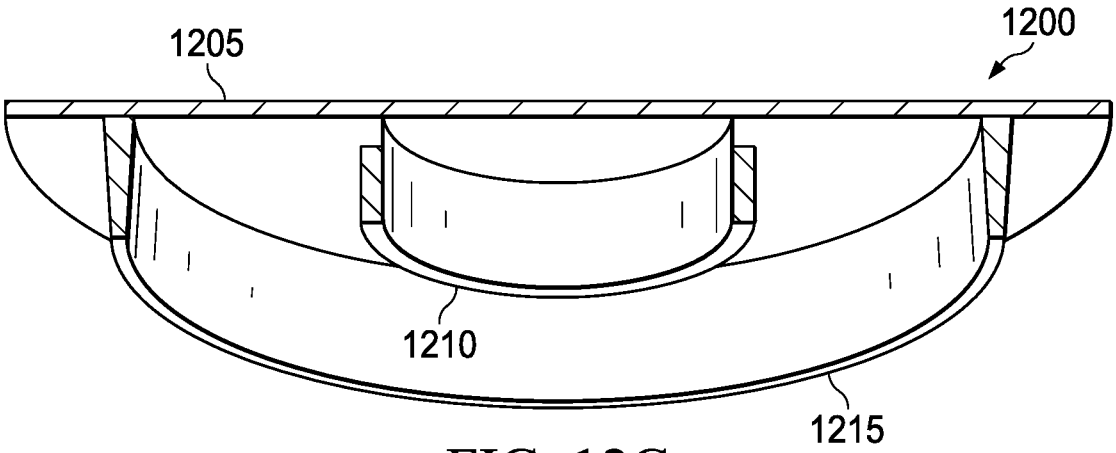

FIGS. 12A-12C illustrate a partial view of another embodiment of an acoustic transducer 1200 with several components removed for descriptive purposes. The acoustic transducer 1200 illustrated in FIGS. 12A-12C is, for example, a subwoofer 1200. The following description of further embodiments focuses on the differences with previously described embodiments. Therefore, it should be assumed that features of the previously described embodiments are or at least can be implemented in these further embodiments, unless explicitly stated otherwise. The acoustic transducer 1200 in FIG. 12A includes a diaphragm 1205 and a former 1210. The acoustic transducer 1200 is illustrated in FIG. 12A without a drop ring in order to show the performance improvement of the acoustic transducer 1200 when a drop ring is included in the acoustic transducer 1200. FIG. 12B illustrates a drop ring 1215 that is positioned at the nodal point of the diaphragm 1205. FIG. 12C illustrates a drop ring 1215 that is positioned outside of the nodal point of the diaphragm 1205 (i.e., further away from the center of the diaphragm than the nodal point).

The drop ring 1215 is, for example, made of a light cellular plastic material and has a trapezoidal shape. The trapezoidal shape creates a greater adhesion area between the drop ring 1215 and the diaphragm 1205, but adds less mass than a uniform (e.g., rectangular) drop ring. Limiting the mass of the drop ring 1215 helps increase the resonant frequency of the acoustic transducer 1200. The first or smaller end of the trapezoidal drop ring 1215 would connect to a spider of the acoustic transducer 1200. The second or larger end of the trapezoidal drop ring 1215 connects to the diaphragm 1205. In the illustrated embodiments of FIGS. 12B and 12C, a ratio of the larger end of the trapezoidal drop ring 1215 to the smaller end of the trapezoidal drop ring 1215 is approximately 4:2. In some embodiments, the smaller end of the trapezoidal drop ring 1215 has a width of approximately 2 mm and the larger end of the trapezoidal drop ring 1215 has a width of approximately 4 mm. In the embodiment illustrated in FIG. 12B, the nodal point of the acoustic transducer 1200 is centered on the larger end of the trapezoidal drop ring 1215.

Figure 12D:
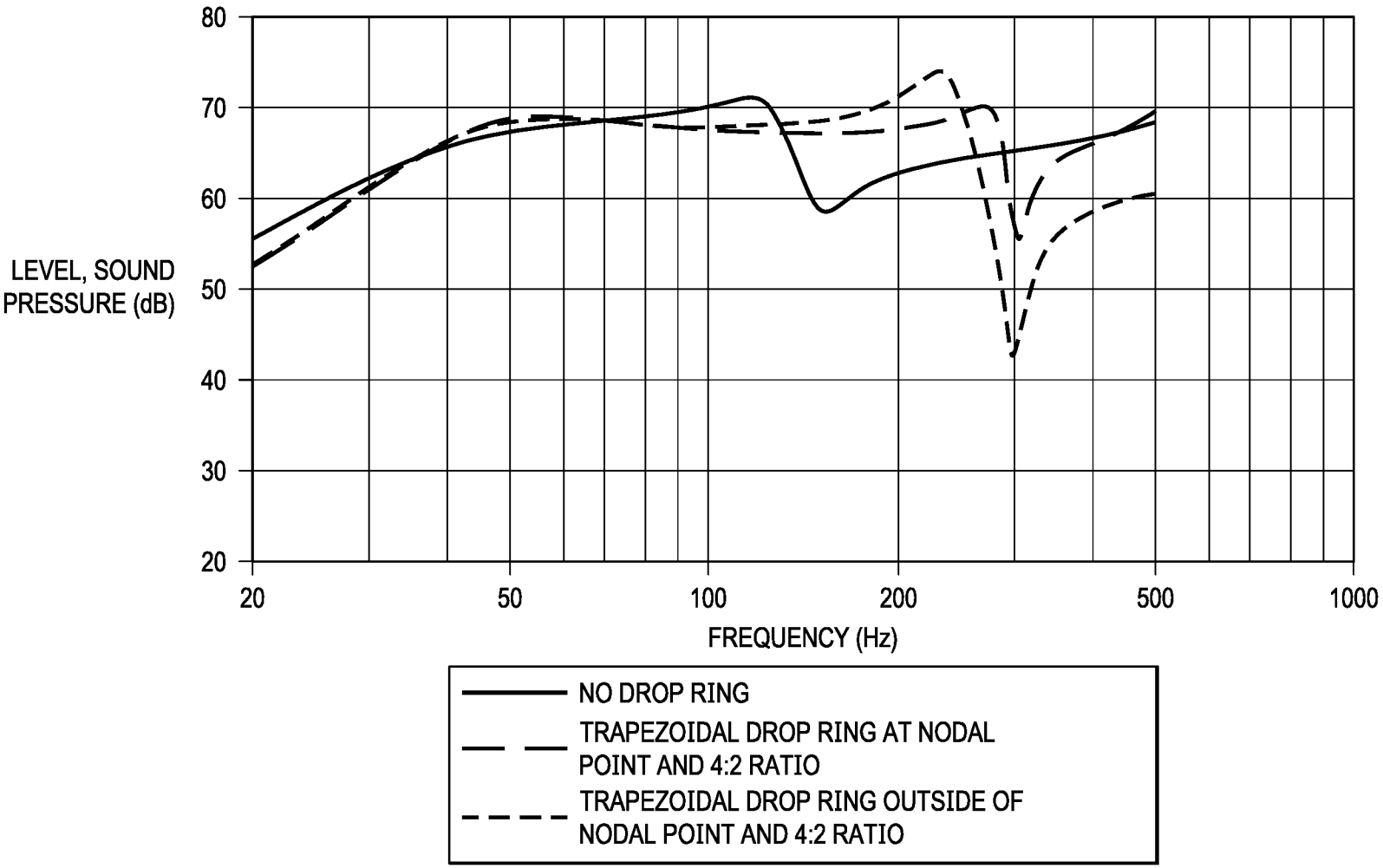
FIG. 12D is a graph of sound pressure versus frequency for the drop ring configurations illustrated in FIGS. 12A, 12B, and 12C.

FIG. 12D is a graph that illustrates the frequency response characteristics of the acoustic transducer 1200 of FIGS. 12A, 12B, and 12C. The embodiment of the acoustic transducer 1200 that does not include a drop ring again demonstrates a significant reduction in sound pressure when the frequency of the acoustic transducer 1200 reaches approximately 125 Hz (i.e., the resonant frequency of the acoustic transducer 1200). The flexure associated with the diaphragm assembly resonance results in a loss of sound pressure and produces harmonic distortion in the output of the speaker that is undesirable. As such, the higher the frequency at which the diaphragm assembly resonance occurs, the better the acoustic transducer 1200 will perform. If the acoustic transducer 1200 is a subwoofer, which would not typically be operated at frequencies greater than approximately 200 Hz, having the sound pressure reduction occur at a frequency greater than 200 Hz would greatly improve the overall performance of the acoustic transducer 1200. As shown in FIG. 12D, both of the embodiments of the acoustic transducer 1200 that include the drop ring 1215 (both at the nodal point and outside the nodal point of the acoustic transducer 1200) demonstrate a sound pressure reduction at a frequency of greater than approximately 200 Hz (e.g., approximately 250 Hz for the drop ring outside the nodal point and approximately 290 Hz for the drop ring at the nodal point). As a result, the drop ring 1215 significantly improves the frequency response characteristics of the acoustic transducer 1200.

Figure 13A:
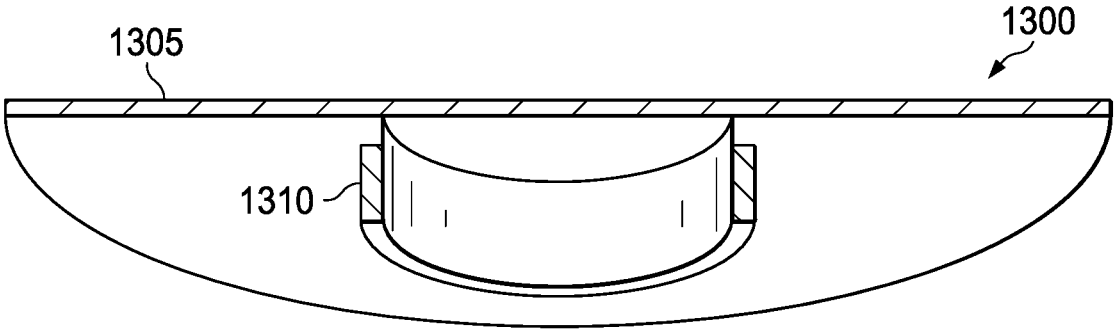
FIGS. 13A, 13B, 13C, and 13D illustrate drop ring configurations for a subwoofer.
Figure 13B:
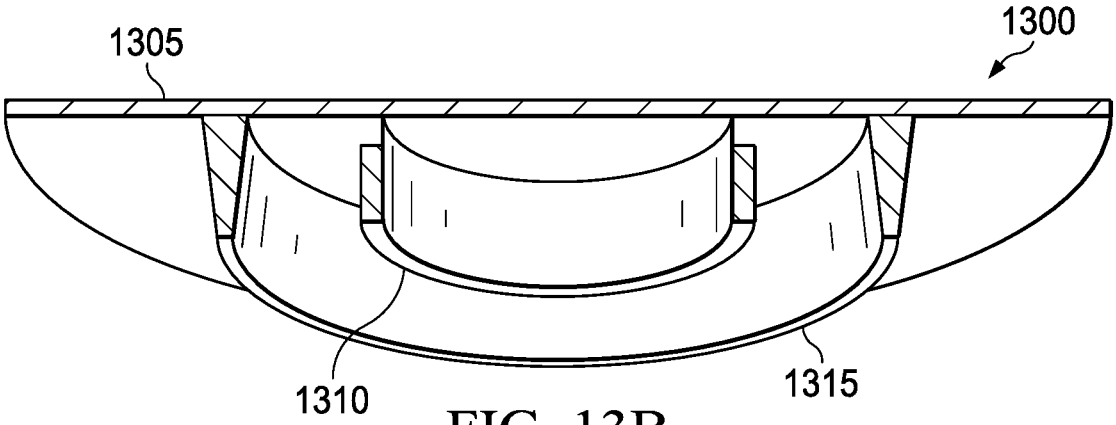
Figure 13C:
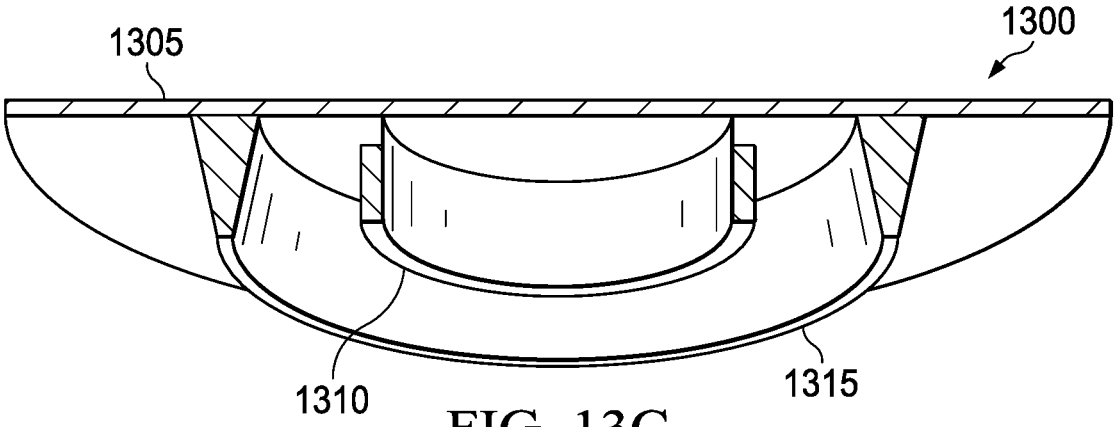
Figure 13D:
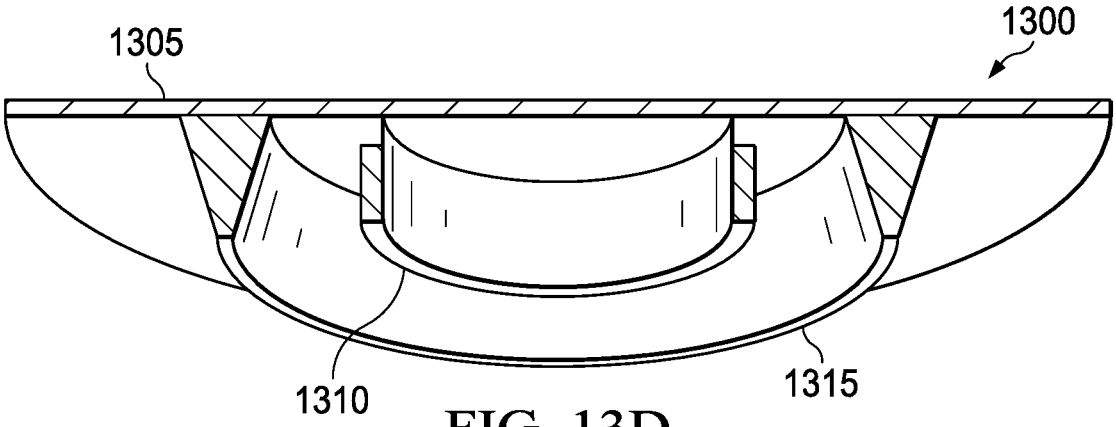

FIGS. 13A-13D illustrate a partial view of another embodiment of an acoustic transducer 1300 with several components removed for descriptive purposes. The acoustic transducer 1300 illustrated in FIGS. 13A-13D is, for example, a subwoofer 1300. The following description of further embodiments focuses on the differences with previously described embodiments. Therefore, it should be assumed that features of the previously described embodiments are or at least can be implemented in these further embodiments, unless explicitly stated otherwise. The acoustic transducer 1300 in FIG. 13A includes a diaphragm 1305 and a former 1310. The acoustic transducer 1300 is illustrated in FIG. 13A without a drop ring in order to show the performance improvement of the acoustic transducer 1300 when a drop ring is included in the acoustic transducer 1300. FIGS. 13B, 13C, and 13D illustrate a drop ring 1315 that is positioned at the nodal point of the diaphragm 1305.

The drop ring 1315 is, for example, made of a light cellular plastic material and has a trapezoidal shape. The trapezoidal shape creates a greater adhesion area between the drop ring 1315 and the diaphragm 1305, but adds less mass than a uniform (e.g., rectangular) drop ring. Limiting the mass of the drop ring 1315 helps increase the resonant frequency of the acoustic transducer 1300. The first or smaller end of the trapezoidal drop ring 1315 would connect to a spider of the acoustic transducer 1300. The second larger end of the trapezoidal drop ring 1315 connects to the diaphragm 1305. In the illustrated embodiment of FIG. 13B, a ratio of the larger end of the trapezoidal drop ring 1315 to the smaller end of the trapezoidal drop ring 1315 is approximately 6:2. In some embodiments, the smaller end of the trapezoidal drop ring 1315 has a width of approximately 2 mm and the larger end of the trapezoidal drop ring 1315 has a width of approximately 6 mm. In the illustrated embodiment of FIG. 13C, a ratio of the larger end of the trapezoidal drop ring 1315 to the smaller end of the trapezoidal drop ring 1315 is approximately 8:2. In some embodiments, the smaller end of the trapezoidal drop ring 1315 has a width of approximately 2 mm and the larger end of the trapezoidal drop ring 1315 has a width of approximately 8 mm. In the illustrated embodiment of FIG. 13D, a ratio of the larger end of the trapezoidal drop ring 1315 to the smaller end of the trapezoidal drop ring 1315 is approximately 10:2. In some embodiments, the smaller end of the trapezoidal drop ring 1315 has a width of approximately 2 mm and the larger end of the trapezoidal drop ring 1315 has a width of approximately 10 mm. In the embodiments illustrated in FIGS. 13B, 13C, and 13D, the nodal point of the acoustic transducer 1300 is centered on the larger end of the trapezoidal drop ring 1315.

Figure 13E:
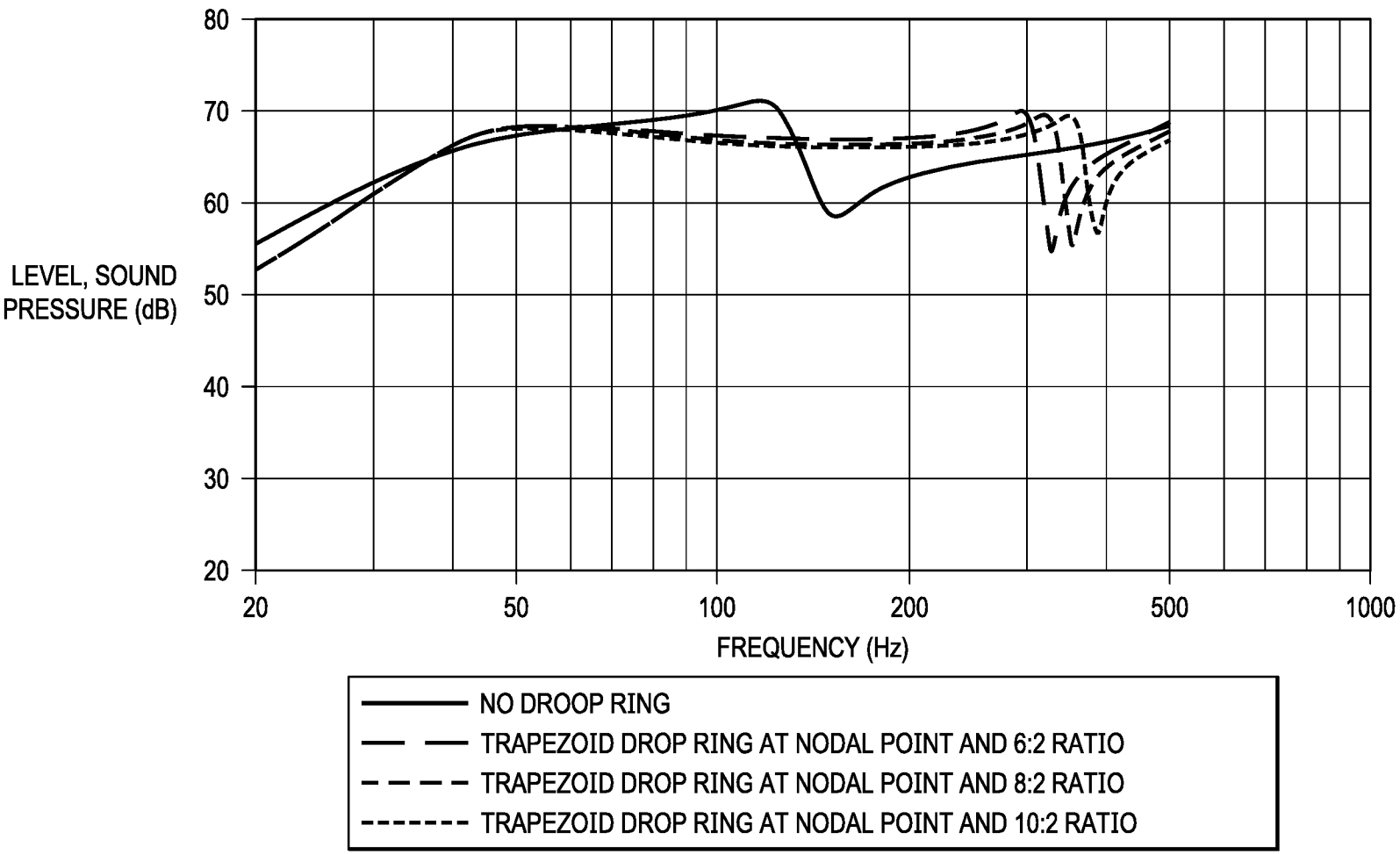
FIG. 13E is a graph of sound pressure versus frequency for the drop ring configurations illustrated in FIGS. 13A, 13B, 13C, and 13D.

FIG. 13E is a graph that illustrates the frequency response characteristics of the acoustic transducer 1300 of FIGS. 13A, 13B, 13C, and 13D. The embodiment of the acoustic transducer 1300 that does not include a drop ring again demonstrates a significant reduction in sound pressure when the frequency of the acoustic transducer 1300 reaches approximately 125 Hz (i.e., the resonant frequency of the diaphragm assembly). The flexure associated with the diaphragm assembly resonance results in a loss of sound pressure and produces harmonic distortion in the output of the speaker that is undesirable. As such, the higher the frequency at which diaphragm assembly resonance occurs, the better the acoustic transducer 1300 will perform. If the acoustic transducer 1300 is a subwoofer, which would not typically be operated at frequencies greater than approximately 200 Hz, having the sound pressure reduction occur at a frequency greater than 200 Hz would greatly improve the overall performance of the acoustic transducer 1300. As shown in FIG. 13E, each of the embodiments of the acoustic transducer 1300 that include the drop ring 1315 demonstrate a sound pressure reduction at a frequency of greater than approximately 200 Hz (e.g., at least 300 Hz for each embodiment and approximately 350 Hz for the embodiment of FIG. 13D). As a result, the drop ring 1315 significantly improves the frequency response characteristics of the acoustic transducer 1300.

Figure 13F:
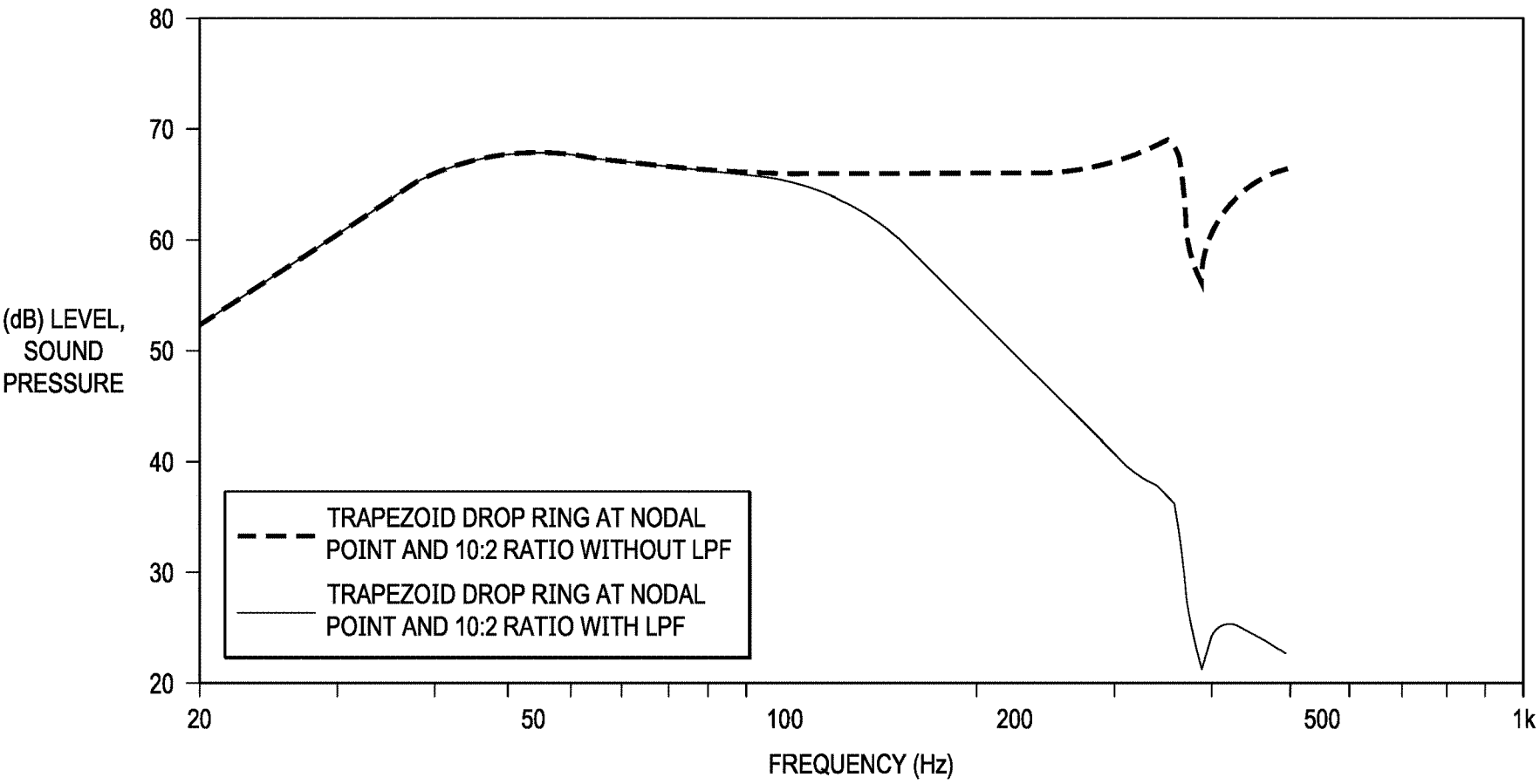
FIG. 13F is a graph of sound pressure versus frequency for the drop ring configurations illustrated in FIG. 13D with and without a low-pass filter.

FIG. 13F is a graph that illustrates the frequency response characteristics of the acoustic transducer 1300 of FIG. 13D with and without the inclusion of a low-pass filter ("LPF"), such as a fourth-order Butterworth LPF that may typically be applied to an acoustic transducer, such as acoustic transducer 1300, when implemented in a system. As illustrated in FIG. 13F, the frequency response characteristics of the acoustic transducer 1300 without the LPF experiences a step in acoustic output due to the bending resonance at a frequency of approximately 350 Hz. However, this artifact occurs at a sound pressure level of approximately 70 decibels. The frequency response characteristics of the acoustic transducer 1300 with the LPF again experiences a step in acoustic output due to the bending resonance at a frequency of approximately 350 Hz. However, this artifact occurs at a sound pressure level of approximately 40 decibels, which is inaudible when, for example, a mid-range transducer is crossed over to reproduce frequencies in that range.

Systems, methods, and devices in accordance with the present disclosure may take any one or more of the following configurations. Accordingly, the invention may be embodied in any of the forms described herein, including, but not limited to the following Enumerated Example Embodiments (EEEs) which described structure, features, and functionality of some portions of the present invention:

(EEE1) A subwoofer comprising:

a housing;

a diaphragm;

a spider; and a motor that includes a backplate, a frontplate, a magnet, and a voice coil, a drop ring connecting the diaphragm to the spider at a circumference of the spider, the drop ring extending parallel with respect to the central axis of the housing.

wherein the circumference of the spider is spaced away from the motor, and wherein the drop ring is connected to the diaphragm at a resonant node of the diaphragm.

(EEE2) The subwoofer according to (EEE1), wherein the circumference of the spider is spaced apart from the motor.

(EEE3) The subwoofer according to (EEE1) or (EEE2), wherein an outer spider diameter is greater than an outer diaphragm diameter.

(EEE4) The subwoofer according to any of (EEE1) to (EEE3), further comprising:

a first clearance excursion corresponding to a first distance between the backplate and a base of the voice coil; and a second clearance excursion corresponding to a second distance between the spider and a rear portion of the housing.

(EEE5) The subwoofer according to (EEE4), wherein the first distance of the first clearance excursion is greater than the second distance of the second clearance excursion.

(EEE6) The subwoofer according to (EEE4) or (EEE5), further comprising:

a third clearance excursion corresponding to a third distance between the diaphragm and the frontplate.

(EEE7) The subwoofer according to (EEE6), wherein the third distance of the third clearance excursion is approximately equal to the second distance of the second clearance excursion.

(EEE8) The subwoofer according to any of (EEE1) to (EEE7), wherein:

the spider includes an outer spider diameter; and the diaphragm includes an outer diaphragm diameter.

(EEE9) The subwoofer according to (EEE8), wherein:

the outer spider diameter is greater than the outer diaphragm diameter.

(EEE10) The subwoofer according to any of (EEE1) to (EEE9), wherein the spider is configured to connect to the housing at a second circumference of the spider.

(EEE11) The subwoofer according to any of (EEE3) to (EEE10), further comprising:

a former configured to connect the voice coil to the diaphragm, the former extending parallel with respect to the central axis of the housing.

(EEE12) The subwoofer according to (EEE1), wherein the spider is configured to connect to the motor at a second circumference of the spider.

(EEE13) The subwoofer according to (EEE12), wherein an outer spider diameter is less than an outer diaphragm diameter.

(EEE14) The subwoofer according to any of (EEE1) to (EEE13), wherein the diaphragm is a flat diaphragm.

(EEE15) The subwoofer according to any of (EEE1) to (EEE14), wherein the drop ring is trapezoidal in shape.

(EEE16) The subwoofer according to (EEE15), wherein a ratio of a length of a first end of the drop ring to a length of a second end of the drop ring is at least 4:2.

(EEE17) A method of manufacturing a subwoofer comprising:

determining a nodal point of a diaphragm;

attaching the diaphragm to a housing;

attaching the spider to a drop ring at a circumference of the spider;

attaching the drop ring to the diaphragm at the nodal point.

(EEE18) The method of (EEE17), wherein:

the drop ring is parallel to a central axis of the housing.

(EEE19) The method of (EEE17) or (EEE18), wherein:

the circumference of the spider is spaced apart from the motor.

(EEE20) The method of any of (EEE17) to (EEE19), further comprising:

attaching a spider to the housing at a second circumference of the spider.

Thus, embodiments described herein provide, among other things, a subwoofer with reduced depth and improved performance near the upper range of frequencies produced by the subwoofer.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments incorporate more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. An acoustic transducer comprising:

a housing;

a diaphragm;

a spider; and a motor that includes a backplate, a frontplate, a magnet, and a voice coil, a drop ring connecting the diaphragm to the spider at a circumference of the spider, the drop ring extending parallel with respect to a central axis of the housing, wherein the circumference of the spider is spaced away from the motor, and wherein the drop ring is connected to the diaphragm at a resonant node of the diaphragm,.

wherein the resonant node of the diaphragm corresponds to a region of minimum movement about which the diaphragm experiences bending.

2. The acoustic transducer according to claim 1, wherein the circumference of the spider is spaced apart from the motor.

3. The acoustic transducer according to claim 2, wherein an outer spider diameter is greater than an outer diaphragm diameter.

4. The acoustic transducer according to claim 1, further comprising:

a first clearance excursion corresponding to a first distance between the backplate and a base of the voice coil; and a second clearance excursion corresponding to a second distance between the spider and a rear portion of the housing.

5. The acoustic transducer according to claim 4, wherein the first distance of the first clearance excursion is greater than the second distance of the second clearance excursion.

6. The acoustic transducer according to claim 5, further comprising:

a third clearance excursion corresponding to a third distance between the diaphragm and the frontplate.

7. The acoustic transducer according to claim 6, wherein the third distance of the third clearance excursion is approximately equal to the second distance of the second clearance excursion.

8. The acoustic transducer according to claim 1, wherein:

the spider includes an outer spider diameter; and the diaphragm includes an outer diaphragm diameter.

9. The acoustic transducer according to claim 8, wherein:

the outer spider diameter is greater than the outer diaphragm diameter.

10. The acoustic transducer according to claim 1, wherein the spider is configured to connect to the housing at a second circumference of the spider.

11. The acoustic transducer according to claim 10, further comprising:

a former configured to connect the voice coil to the diaphragm, the former extending parallel with respect to the central axis of the housing.

12. The acoustic transducer according to claim 1, wherein the spider is configured to connect to the motor at a second circumference of the spider.

13. The acoustic transducer according to claim 12, wherein an outer spider diameter is less than an outer diaphragm diameter.

14. The acoustic transducer according to claim 1, wherein the diaphragm is a flat diaphragm.

15. The acoustic transducer according to claim 1, wherein the drop ring is trapezoidal in shape.

16. The acoustic transducer according to claim 15, wherein a ratio of a length of a first end of the drop ring to a length of a second end of the drop ring is at least 4:2.

17. A method of manufacturing an acoustic transducer, the method comprising:

determining a nodal point of a diaphragm, wherein the nodal point of the diaphragm corresponds to a region of minimum movement about which the diaphragm experiences bending;

attaching the diaphragm to a housing;

attaching a spider to a drop ring at a circumference of the spider; and attaching the drop ring to the diaphragm at the nodal point.

18. The method of claim 17, wherein:

the drop ring is parallel to a central axis of the housing.

19. The method of claim 18, wherein:

the circumference of the spider is spaced apart from a motor.

20. The method of claim 17, further comprising:

attaching the spider to the housing at a second circumference of the spider.

* * * * *